US008536790B2

(12) United States Patent
Inoue et al.

(10) Patent No.: US 8,536,790 B2
(45) Date of Patent: Sep. 17, 2013

(54) LED LIGHTING DEVICE AND HEAD LAMP LED LIGHTING DEVICE

(75) Inventors: Yu Inoue, Tokyo (JP); Takashi Ohsawa, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 293 days.

(21) Appl. No.: 13/119,446

(22) PCT Filed: Sep. 18, 2009

(86) PCT No.: PCT/JP2009/004739

§ 371 (c)(1),
(2), (4) Date: Mar. 17, 2011

(87) PCT Pub. No.: WO2010/073437

PCT Pub. Date: Jul. 1, 2010

(65) Prior Publication Data

US 2011/0169411 A1 Jul. 14, 2011

(30) Foreign Application Priority Data

Dec. 26, 2008 (JP) ..... 2008-332837

(51) Int. Cl.
*H05B 37/02* (2006.01)

(52) U.S. Cl.
USPC ..... 315/82; 315/209 R; 315/210; 315/297; 315/307

(58) Field of Classification Search
USPC ..... 315/82, 209 R, 210, 201, 224, 247, 315/291, 297, 246, 307, 312; 363/56.11, 363/21.13, 90, 84
See application file for complete search history.

(56) References Cited

U.S. PATENT DOCUMENTS

| | | | | |
|---|---|---|---|---|
| 6,121,852 | A | 9/2000 | Mizoguchi et al. | |
| 6,747,420 | B2 | 6/2004 | Barth et al. | |
| 7,369,384 | B2 * | 5/2008 | Inaba | 361/91.1 |
| 7,583,035 | B2 | 9/2009 | Shteynberg et al. | |
| 7,642,762 | B2 * | 1/2010 | Xie et al. | 323/282 |
| 7,863,836 | B2 * | 1/2011 | Mednik et al. | 315/360 |
| 8,102,683 | B2 * | 1/2012 | Gaknoki et al. | 363/56.11 |
| 8,106,597 | B2 * | 1/2012 | Mednik et al. | 315/247 |
| 8,130,519 | B2 * | 3/2012 | Mednik et al. | 363/74 |
| 2005/0007085 | A1 | 1/2005 | Murakami | |
| 2005/0213353 | A1 | 9/2005 | Lys | |
| 2006/0164770 | A1 | 7/2006 | Inaba | |

(Continued)

FOREIGN PATENT DOCUMENTS

| | | | |
|---|---|---|---|
| DE | 296 22 335 | U1 | 2/1997 |
| EP | 0 910 158 | A1 | 4/1999 |

(Continued)

*Primary Examiner* — Vibol Tan
(74) *Attorney, Agent, or Firm* — Birch, Stewart, Kolasch & Birch, LLP

(57) ABSTRACT

When a current which is conducted from a direct current power supply 8 to a choke coil L1 after a switching transistor 7 is turned on has a predetermined value, an LED lighting device. lights up an LED series circuit by conducting a pulse-shaped current which occurs by turning off the switching transistor 7 to the LED series circuit. A cycle period at which the pulse-shaped current is generated is determined according to the average value of the current flowing through the LED series circuit by using an oscillator (VCO) 4. The LED lighting device controls each of the pulse-shaped current value and the average current value arbitrarily.

18 Claims, 9 Drawing Sheets

(56) References Cited

U.S. PATENT DOCUMENTS

| | | | | |
|---|---|---|---|---|
| 2006/0181256 | A1 | 8/2006 | Nagai | |
| 2006/0255753 | A1 | 11/2006 | Sawada et al. | |
| 2006/0290479 | A1 | 12/2006 | Akatsuka et al. | |
| 2007/0024213 | A1 | 2/2007 | Shteynberg et al. | |
| 2009/0066262 | A1 | 3/2009 | Tateishi et al. | |
| 2010/0283322 | A1* | 11/2010 | Wibben | 307/31 |
| 2011/0227503 | A1* | 9/2011 | Yuan et al. | 315/294 |
| 2012/0049755 | A1* | 3/2012 | Shimizu et al. | 315/246 |

FOREIGN PATENT DOCUMENTS

| | | | |
|---|---|---|---|
| JP | 10-146049 | | 5/1998 |
| JP | 11-087620 | | 3/1999 |
| JP | 11-178333 | A | 7/1999 |
| JP | 2001-313423 | A | 11/2001 |
| JP | 2002-203988 | A | 7/2002 |
| JP | 2005-11739 | A | 1/2005 |
| JP | 2005-110356 | A | 4/2005 |
| JP | 2006-210272 | A | 8/2006 |
| JP | 2006-262686 | | 9/2006 |
| JP | 2006-310402 | A | 11/2006 |
| JP | 2006-319221 | A | 11/2006 |
| JP | 2007-11457 | A | 1/2007 |
| JP | 2007-103232 | | 4/2007 |
| JP | 2007-210377 | A | 8/2007 |
| JP | 2007-220812 | A | 8/2007 |
| JP | 2007-529872 | A | 10/2007 |
| JP | 2008-168771 | A | 7/2008 |
| JP | 2008-205036 | A | 9/2008 |
| WO | WO 98/35432 | A1 | 8/1998 |
| WO | WO 2007/069371 | A1 | 6/2007 |

* cited by examiner

LED LIGHTING DEVICE AND HEAD LAMP LED LIGHTING DEVICE

FIELD OF THE INVENTION

The present invention relates to an LED lighting device and a head lamp LED lighting device which make an LED (Light Emitting Diode), which is used as a light source such as a vehicle-mounted head lamp or a vehicle-mounted tail lamp, light up.

BACKGROUND OF THE INVENTION

In recent years, LEDs are beginning to be used as a light source for a vehicle-mounted head lamp or a vehicle-mounted tail lamp. However, LEDs still have a low light-emitting efficiency, and, in order to make sure that LEDs used for a head lamp have a sufficient light emission quantity, supplied power of the same order as that to an electric-discharge head lamp is required while the head lamp which employs the LEDs and an electric power supply for lighting requires the same order of power consumption in the LEDs and the electric power supply for lighting as that of an electric-discharge head lamp. Therefore, at the present time, it is necessary to reduce both the power consumption of the LEDs and that of the lighting electric power supply from the viewpoint of both measures against heat generation in the LEDs and the lighting electric power supply, and energy saving. The same problem arises even in a case in which LEDs are used as a light source for a tail lamp.

Furthermore, people visually recognize the brightness of LEDs at the time of a peak current conducting through the LEDs as the brightness of the light source. Therefore, as a method of increasing the light emission quantity of LEDs visually with small lighting electric power, a lighting method of using the fact that a light source having a larger peak current is perceived as a brighter one, and, in a structure using LEDs or fluorescent display tubes for a display for displaying numbers, characters, and so on, alternately and repeatedly switching between conduction (lighting) of a large current pulse having a short time duration which exceeds a DC rated current through each segment (each light emitting element such as an LED or a fluorescent display tube) and nonconduction (lights-out) of the large current pulse at a high speed in such a way that the switching is not recognized visually as a flicker while maintaining the average power at rated power or smaller is generally used.

As a technology of carrying out such pulse lighting, a technology of conducting a pulsed current to LEDs for illumination to make them light up is described in the following related art references. For example, in patent reference 1, a technology of making variable the energy stored in a coil when a switching element in a step-up electric power supply is placed in an on state to acquire an arbitrary amount of output current for LED lighting is disclosed. In order to implement this technology, a device described in patent reference 1 uses an alternating current power supply as an electric power supply, averages the output current during a time period longer than the period of the alternating current power supply, and controls properly the current which is conducted to the switching element of the step-up electric power supply when the switching element is placed in the on state in such a way that the averaged output current has a target current value.

Furthermore, in patent reference 2, a technology of fixing the energy stored in a coil when a switching element in a step-up electric power supply is placed in an on state to a constant to acquire an arbitrary amount of output current for LED lighting is disclosed. A circuit described in patent reference 2 uses a direct current power supply of a portable device as an electric power supply, averages an output current of the electric power supply, and changes the ratio between the on and off switching time duration of the switching element of the step-up electric power, and the off duration of time that the switching element is held in the off state in such a way that the averaged output current has a target current value to control the switching element to make this switching element perform intermittently.

RELATED ART DOCUMENT

Patent Reference

Patent reference 1: JP,2001-313423,A
Patent reference 2: JP,2002-203988,A

SUMMARY OF THE INVENTION

The brightness and light color of a light source for a headlamp are defined, and, in order to acquire an appropriate light color, it is necessary to set the current which is conducted to LEDs to a specific value. A problem with the device described in patent reference 1 is, however, that because the device changes the current which is conducted to the LEDs by making variable the energy stored in the coil, the light color changes according to the amount of current conducted to the LEDs, and the device is not preferable as a lighting power supply for a head lamp which uses LEDs as a light source.

It is said that a general light source for illumination needs to have a lighting frequency equal to or larger than 200 Hz so that flicker (flicker) cannot be recognized. Considering this fact, it is assumed that the LEDs are made to light up at a lighting frequency at which no flicker is recognized visually also in the circuit disclosed by patent reference 2. However, in an optical system which applies light to an object, a stroboscope phenomenon in which the object illuminated appears intermittently occurs even at a similar lighting frequency, and such a flicker as mentioned above is easy to be recognized visually. For example, because the above-mentioned stroboscope phenomenon remarkably occurs at a lighting frequency of 200 Hz as mentioned above in a head lamp for illuminating a forward area in front of a vehicle running (illuminating an object moving at a high speed), the head lamp is insufficient as a light source and needs to be made to light up at a higher frequency.

In addition, the circuit described in patent reference 2 fixes the energy stored in the coil for each switching operation of the switching element to a constant to fix the LED conduction current for each switching operation to a constant. This lighting method is effective in preventing the light color of the LEDs from changing with a change of the conduction current. However, the lighting method does not take into consideration a measure for making unnoticeable either the difference between light in a bright state in which the LEDs are blinking and light in a dark state in which the LEDs stay out, or a variation of light (a flicker) so as to apply the device to a vehicle-mounted head lamp, the difference and the variation of light occurring at the timing at which to repeat the turning on and off of the switching element so as to light up the LEDs and make the LEDs blink at a high frequency and at the timing at which to hold the switching element in the off state so as to turn out the LEDs and make the LEDs stay out.

The present invention is made in order to solve the above-mentioned problems, and it is therefore an object of the present invention to provide an LED lighting device and a head lamp LED lighting device that can reduce the component count with a simple structure and that reduce their power consumptions and prevent a flicker from being recognized while maintaining visual brightness, or that can maintain light color and brightness at a predetermined color and at a predetermined brightness value, respectively.

In accordance with the present invention, there is provided an LED lighting device including: an LED circuit connected to a direct current power supply via an inductor; a switching element; a unit for turning on the switching element to conduct a current from the direct current power supply to the inductor, and, when the current conducted to the above-mentioned inductor reaches a predetermined value, turning off the switching element and outputting a pulse-shaped current which is generated through turning off the above-mentioned switching element from the above-mentioned inductor to the LED circuit to conduct the pulse-shaped current generated by the above-mentioned inductor to the LED circuit, thereby lighting up the above-mentioned LED circuit and a cycle determining unit for determining a cycle period at which the switching element operates according to an average of the current conducted to the LED circuit.

In accordance with the present invention, the LED lighting device can be implemented via a simple circuit which carries out on and off control of the switching element at a predetermined cycle period, and therefore the component count can be reduced. Furthermore, because the LEDs are made to light up by the pulse-shaped current, the LEDs can be lit up more brightly and more visually than they are made to light up by a direct current. Therefore, when the LEDs are lit up with the same degree of perceived brightness as that when they are made to light up by a direct current, the power consumption of the LED lighting device can be reduced compared with that in the case of direct current lighting. In addition, by changing the average current value while maintaining the pulse-shaped current value, the LED lighting device can change the brightness of the LEDs while maintaining the light color of the LEDs at a predetermined light color. In contrast with this, by changing the pulse-shaped current value while maintaining the average current value, the LED lighting device can change the light color of the LEDs while maintaining the brightness of the LEDs. Because the lighting using this pulse-shaped current is repeated at a short cycle period through turning on and off the switching element, any flicker is not recognized.

EMBODIMENTS OF THE INVENTION

Hereafter, in order to explain this invention in greater detail, the preferred embodiments of the present invention will be described with reference to the accompanying drawings.

Embodiment 1

Figure 1:
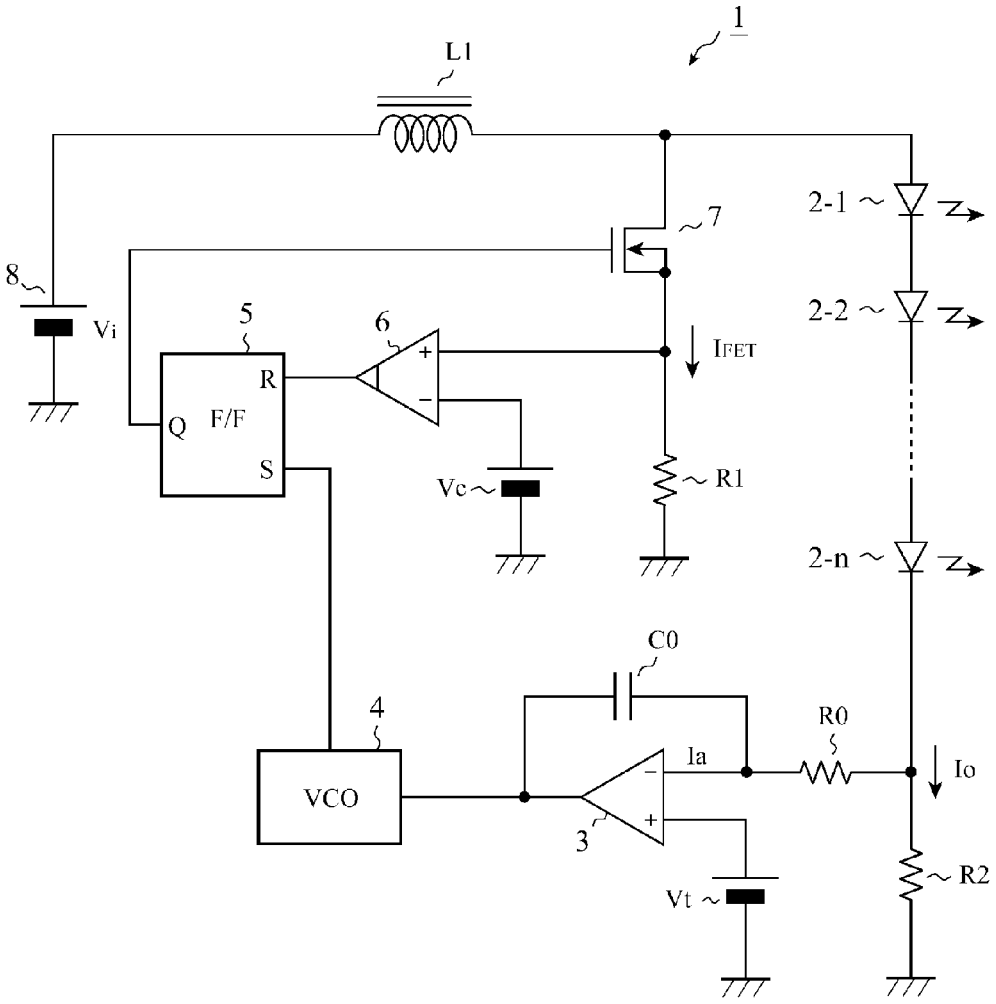
FIG. 1 is a circuit diagram showing the structure of an LED lighting device in accordance with Embodiment 1 of the present invention.

FIG. 1 is a circuit diagram showing the structure of an LED lighting device in accordance with Embodiment 1 of the present invention. In FIG. 1, an LED lighting power supply 1 is provided with LEDs 2-1 to **2-*n*, an error amplifier 3, an oscillator (VCO; Voltage Controlled Oscillator) 4, a flip-flop 5, a comparator 6, a switching transistor 7, a choke coil L1 (an inductor), and a direct current power supply 8 having a supply voltage V1. The LEDs 2-1 to 2-*n* construct an LED circuit (abbreviated as an LED series circuit from here on) which consists of the n LEDs connected in series, and an anode of the LED 2-1 at an end of the LED series circuit is connected to an end of the choke coil L1 and a cathode of the LED 2-*n* at another end of the LED series circuit is grounded via a shunt resistance R2**.

The error amplifier 3 has an inverted input terminal connected to the cathode of the LED **2-*n* via a resistor R0, a non-inverted input terminal connected to a reference power supply Vt that provides the error amplifier with a target current, and an output terminal connected to the oscillator 4 and also connected, via a capacitor C0, to a junction point between the inverted input terminal thereof and the resistor R0. The oscillator 4 generates a square wave having an oscillating frequency according to a voltage applied thereto from the error amplifier 3, and outputs the square wave to a set terminal S of the flip-flop 5. The error amplifier 3 and the oscillator 4** construct a cycle determining unit.

The flip-flop 5 (abbreviated as the FF 5 from here on) has the set terminal S connected to an output terminal of the oscillator 4, a reset terminal R connected to an output terminal of the comparator 6, and an output terminal Q connected to a gate terminal of the switching transistor 7. When a rising edge is inputted to the set terminal S, the FF 5 makes the potential of the output terminal Q have a high level, whereas when a rising edge is inputted to the reset terminal R, the FF 5 makes the potential of the output terminal Q have a low level. The FF 5 is not limited to an RS flip-flop, and can be any circuit that has two stable output states in order to hold the turning on and off of the switching transistor 7.

The comparator 6 has an inverted input terminal connected to a reference power supply Vc that provides the comparator with a predetermined current value, a non-inverted input terminal connected to a junction point between a source terminal of the switching transistor 7 and a shunt resistance R1, and the output terminal connected to the reset terminal R of the FF 5. The above-mentioned FF 5 and the above-mentioned comparator 6 construct a lighting unit.

The switching transistor (a switching element) 7 consists of a field-effect transistor (FET), and has the gate terminal connected to the output terminal Q of the FF 5, a drain terminal connected to a junction point between the choke coil L1 and the LED series circuit, and the source terminal grounded via the shunt resistance R1. The switching transistor controls the current conduction of a current from the direct current power supply 8 to the choke coil L1 by switching between turning on and off.

When the switching transistor 7 enters an on state, the voltage V1 of the direct current power supply 8 is applied to the choke coil L1, and a current is conducted from the direct current power supply 8 to the choke coil L1. In contrast, when the switching transistor 7 enters an off state, a pulsed-shape output current Io (a peak current) flowing out of the choke coil L1 is furnished to the LED series circuit, and the LEDs 2-1 to **2-*n* are made to light up. A step-up power supply (a power supplying unit) is comprised of the switching transistor 7, the direct current power supply 8, and the choke coil L1**.

Next, the operation of the LED lighting device will be explained.

The pulse-shaped output current Io flowing through the series circuit which consists of the LEDs 2-1 to **2-*n* is averaging-processed by the error amplifier 3 which serves as an integrator which uses the resistor R0 and the capacitor C0. The error amplifier 3 compares the value of the averaging-processed current Ia with the target current value from the reference power supply Vt, and applies a voltage which the error amplifier acquires by amplifying the error between them to the oscillator 4**.

The oscillator 4 outputs a square wave having an oscillating frequency according to the output voltage of the error amplifier 3 to the set terminal S of the FF 5. At this time, when the value of the averaged current Ia is larger than the target current value, the oscillator 4 lowers the oscillating frequency, whereas when the value of the averaged current Ia is smaller than the target current value, the oscillator 4 raises the oscillating frequency. The FF 5 outputs a driving signal which makes a transition to a high level (a high potential) at the edge timing of the square wave inputted thereto from the oscillator 4 via the set terminal S to the switching transistor 7 from the output terminal Q so as to turn on the switching transistor 7.

In the above-mentioned structure, a control operation of maintaining the average current Ia (the electric power) which is conducted to the LED series circuit at any value is carried out by advancing or retarding the timing at which to start the on state of the switching transistor 7. More specifically, by controlling the oscillating frequency of the oscillator 4 in such away that the oscillating frequency has an arbitrary value, the number of times that the current is conducted to the gate terminal of the switching transistor 7 per unit time is increased or decreased in such a way that the average (the average current Ia) of the output current To flowing through the LED series circuit is controlled to have a predetermined value.

Furthermore, when the switching transistor 7 is placed in the on state, a voltage showing the current amount of the current $I_{FET}$ which has flowed from the choke coil L1 to between the drain and source of the switching transistor 7 appears across the both ends of the shunt resistance R1. The comparator 6 compares the voltage caused by this current $I_{FET}$ with the predetermined voltage value of the reference power supply Vc to detect whether the voltage drop occurring in the shunt resistance R1 reaches the predetermined voltage value of the reference voltage Vc.

When the above-mentioned voltage drop reaches the voltage of the reference voltage Vc, the comparator 6 makes the reset terminal R of the FF 5 have a high level (a high potential). The FF 5 makes the driving signal which the FF outputs via its output terminal Q have a low level (a low voltage) to turn off the switching transistor 7 at the timing at which the reset terminal R is made to have a high-level potential by the comparator 6.

Figure 2:
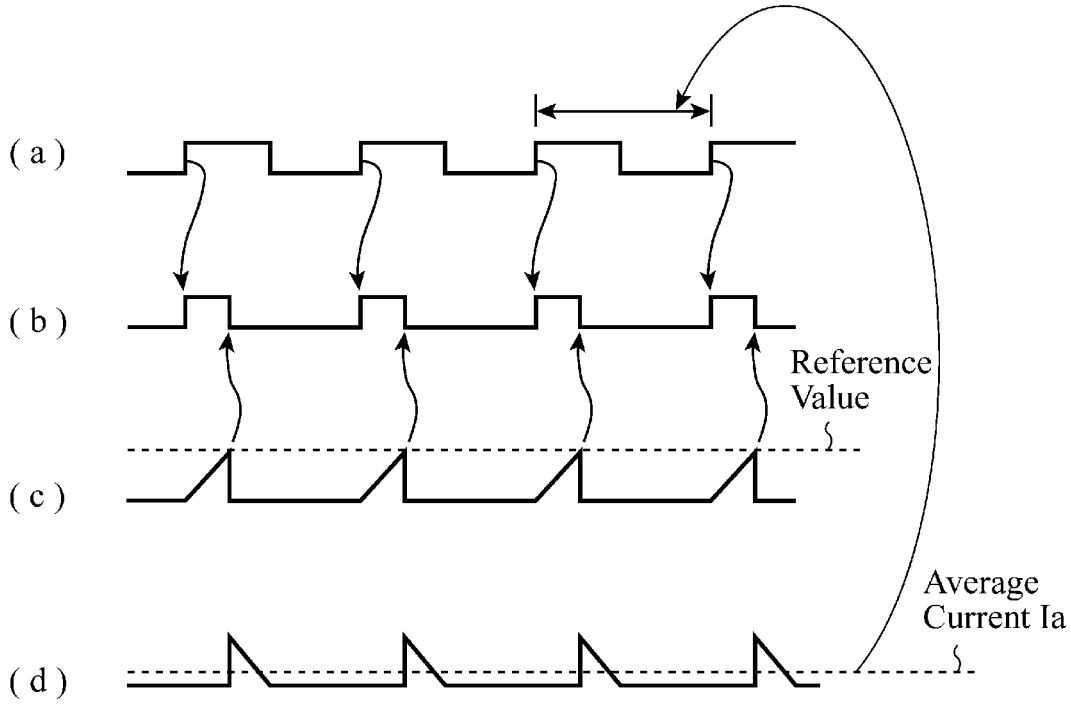
FIG. 2 is a view showing the waveform of the output of each component circuit of the LED lighting device shown in FIG. 1.

FIG. 2 is a view showing the waveform of the output of each component circuit of the LED lighting device shown in FIG. 1. FIG. 2(*a*) shows the waveform of the output voltage of the oscillator (VCO) 4, FIG. 2(*b*) shows the waveform of the output voltage of the FF 5, FIG. 2(*c*) shows the waveform of the current $I_{FET}$ which flows through the choke coil L1 and the switching transistor 7, and FIG. 2(*d*) shows the waveform of the output current Io. In the examples shown in FIGS. 2(*a*) and 2(*b*), at the timing of the rising edge of the square wave inputted from the oscillator 4, the driving signal which the FF 5 outputs via its output terminal Q makes a transition to a high level (a high potential).

The switching transistor 7 enters the on state while the driving signal from the FF 5 is in a high level, and enters the off state when the driving signal makes a transition to a low level (a low voltage). During this on-off period of time, the pulse-shaped current $I_{FET}$ having a peak value as shown in FIG. 2(*c*) flows from the coil L1 to between the drain and source of the switching transistor. A reference value denoted by a dashed line shown in FIG. 2(*c*) shows the voltage of the reference power supply Vc, and a comparison between this reference value and the voltage showing the current amount of the current $I_{FET}$ occurring in the shunt resistance R1 is made by the comparator 6.

The output current Io is the pulse-shaped current which flows from the choke coil L1 into the LED series circuit when the switching transistor 7 is turned off, as shown in FIGS. 2(*b*) and 2(*d*). Furthermore, when the time period during which the switching transistor 7 is turned on and off is fixed to a constant, because the energy stored in the choke coil L1 during each cycle period is constant, the peak value at the head of the output current Io which flows out of the choke coil L1 at the timing at which the switching transistor 7 is turned off is equal to the peak value of the current $I_{FET}$ which flows through the choke coil and the switching transistor at the end at the timing at which the switching transistor 7 is turned on, as shown in FIGS. 2(*c*) and 2(*d*).

The value of the average current Ia shown by a dashed line shown in FIG. 2(*d*) is the current value which the integrator of the error amplifier 3 acquires by averaging-processing the output current Io. A comparison between this value of the average current Ia and the target current from the reference power supply Vt is made by the error amplifier 3, and the value of the average current Ia is controlled in such a way that the value of the average current Ia is fixed to a constant.

In a case in which there is no change in the voltage applied to the LED series circuit and the value of the output current Io is controlled to a constant (the output power is fixed to a constant), when the power supply voltage is high, the duration of current conduction is shortened because the pulse-shaped current $I_{FET}$ reaches the predetermined value in a short time, whereas when the power supply voltage is low, the duration of current conduction is lengthened because it takes much time for the pulse-shaped current $I_{FET}$ to reach the predetermined value.

Therefore, by appropriately setting up both the target current value of the error amplifier 3 and the reference power supply Vc for the comparator 6 to adjust the period of time during which the switching transistor 7 is in the on state, thereby maintaining the pulse-shaped current $I_{FET}$ constant, the peak value of the output current Io which flows through the LED series circuit is fixed to a constant.

The output power during each cycle period having the above-mentioned time period can be given by (the inductance of the choke coil L1×the square of the pulse-shaped current $I_{FET}$)/2. Therefore, because the number of cycles is proportional to the output power by fixing the pulse-shaped current $I_{FET}$ to a constant, the output power can be controlled by controlling the repetition operation in such a way that the repetition operation has an arbitrary cycle period (the output square wave of the oscillator 4 shown in FIG. 2(*a*) has an arbitrary period). The LED lighting device 1 can have the same output polarity as the power supply voltage, or an output polarity which is inverse to that of the power supply voltage.

By thus fixing the value of the pulse-shaped current $I_{FET}$ to a constant, while the peak value of the output current Io is fixed to a constant, the duration of current conduction of the output current Io is shortened when the voltage applied to the LED series circuit is high, whereas the duration of current conduction of the output current Io is lengthened when the above-mentioned voltage is low. As a result, the LED lighting device in accordance with Embodiment 1 can control the output power per one pulse of the output current Io to a substantially constant without carrying out any feedback control particularly.

It is said that a general light source for illumination needs to have a lighting frequency equal to or higher than 200 Hz so that flicker (flicker) cannot be recognized. However, because a head lamp for vehicles is used even under high-speed driving, a stroboscope phenomenon easily occurs. It is therefore necessary to make a head lamp for vehicles light up at a higher frequency. To this end, in accordance with this Embodiment 1, the LED circuit is made to light up at 1 kHz or higher. Preferably, the LED circuit is made to light up at a frequency ranging from 20 kHz at which sounds caused by the switching element and the inductor have frequencies exceeding the audible frequency range to 1 MHz at which the switching element can be easily handled. Thus, the low-cost circuit in accordance with this Embodiment 1 implements the lighting of the LED circuit at the above-mentioned high frequency by outputting the triangular wave which is the non-square wave outputted by the inductor to the LED circuit to control the current which is conducted to the inductor by using the switching element connected in series to the inductor.

Furthermore, in a case in which one head lamp for vehicle is constructed using a plurality of LED lighting devices shown in this Embodiment 1, for example, in a case in which an LED circuit used for each of left and right head lamps is constructed of LED lighting devices in accordance with present Embodiment 1 or in a case in which a plurality of LED circuits which construct each of left and right head lamps are made to light up using a plurality of LED lighting devices in accordance with present Embodiment 1, although variations easily become obvious in the degrees of brightness and the light colors of the plurality of LED circuits, the degrees of brightness and the light colors of the LED lighting devices in accordance with this Embodiment 1 can be adjusted independently and the variations can be therefore made to be hard to recognize.

As mentioned above, the LED lighting device 1 in accordance with this Embodiment 1 is constructed as shown in FIG. 1, and furnishes the current having a high peak value (the output current Io) for each pulse at a predetermined repetition cycle period to light up the LEDs 2-1 to **2-*n*. As a result, because the peak value of the output current Io is fixed to a constant, the light color of the LEDs can be fixed to a constant. Furthermore, by increasing the peak value of the output current Io regardless of the light color, the virtual light emission quantity (brightness) of the LEDs can be increased. In addition, by handling the oscillating frequency of the oscillator 4** to reduce the repetition cycle period, the LED lighting device can be made to repeat cycles of lighting and lights-out of the LEDs at shorter periods and to prevent any flicker (flicker) from being recognized visually.

Furthermore, in above-mentioned Embodiment 1, although the case in which the LEDs have an equivalent light color at the specified current and are made to light up with the equivalent light color is shown, the LEDs can be alternatively constructed to have a different light color according to a specific conduction current by using a phenomenon in which the light color of each LED varies according to the conduction current, and the LEDs can be made to light up with a desired light color by selecting the conduction current appropriately.

For example, although mass production techniques for mass-producing LEDs are progressing day to day, an LED head lamp needs to be constructed using a plurality of LEDs per each vehicle because each LED still has a small light emission quantity at this point in time. Furthermore, there is a case in which variations in each of the light emission quantity and light color of each LED appear to have a normal distribution, and, as a plurality of LEDs used for an LED head lamp, a plurality of LEDs having the same light emission quantity and the same light color at a certain current value (a specified current value) need to be used selectively from LEDs having the above-mentioned distributions. In this case, as manufacturing process of manufacturing an LED head lamp, there can be a process of allowing a manufacturing maker of LEDs to select LEDs having the same light emission quantity and the same light color at the specified current value to complete an LED head lamp which is made to light up at the specified current value from the selected LEDs.

However, the LED lighting device in accordance with this Embodiment 1 can conduct an average current value which differs from the specified current value and a peak current value which differs from its specified peak value to the LEDs thereof. Particularly, in a case in which each head lamp is constructed using a plurality of LED circuits in each of which a plurality of LEDs are connected in series per each vehicle, the plurality of LED circuits which are made to have different emission quantities and different light colors at the specified current value can be constructed in such a way as to have light emission quantities brought close to an equivalent light emission quantity and light colors brought close to an equivalent light color by making the average current values and peak current values conducted to the plurality of LED circuits different from one another.

Similarly, even though the plurality of LED circuits which are made to have different emission quantities and different light colors at the specified current value are used, each head lamp of each vehicle can be made to have a light emission quantity brought close to a specified light emission quantity and a light color brought close to a specified light color.

For example, in the structure of FIG. 1, the current $I_{FET}$ which flows through the choke coil L1 and the switching transistor 7, which is detected by the shunt resistance R1, can be controlled to have any value by adjusting the reference value (the voltage Vc) of the comparator 6. Even if the pulse-shaped current $I_{FET}$ conducted to the choke coil and the switching transistor is changed to any value by changing the reference voltage Vc, the light emission quantity (brightness) of the LED series circuit does not vary as long as the average (the average current Ia) of the conduction current (the output current Io) conducted to the LED series circuit is controlled by the error amplifier 3. As a result, the light color can be changed while the light emission quantity (brightness) is maintained constant by increasing the peak current and lengthening the repetition cycle period. Also in Embodiments 2 to 7 which will be mentioned below, this structure can be applied.

Furthermore, in above-mentioned Embodiment 1, the LED lighting device can be used as a power supply for DRL (Daytime Running Lamps) by controlling the conduction current (the average current Ia) conducted to the LED series circuit to a fixed low current. For example, by applying the LED lighting device 1 in accordance with Embodiment 1 to an LED-type head lamp, this head lamp can be made to light up at the same light color both in a bright lighting state during normal vehicle running (with a high light emission quantity) and in a dimming (DRL) lighting state with a reduced light emission quantity for daytime vehicle running.

Thus, in accordance with Embodiment 1, the LED lighting device can be implemented in such a way as to be ready for DRL without adding any part for exclusive use. Switching from the lighting during normal vehicle running to the DRL lighting state with a reduced light emission quantity or switching from the DRL lighting state to the lighting during normal vehicle running can be carried out by making the voltage Vt of FIG. 1 variable and changing the value of the voltage Vt according to a switch operation done by a not-shown vehicle driver or a result of detection performed by a not-shown illumination detecting unit for detecting the ambient temperature of the vehicle, for example. At this time, unless the voltage Vc of FIG. 1 is changed, the light emission quantity can be changed without changing the light color of the LEDs. Furthermore, in a case of changing the light color of the LEDs, the voltage Vc of FIG. 1 can be changed. As a unit for changing the voltage Vt of FIG. 1, and a unit for changing the voltage Vc of FIG. 1, a first control unit or a second control unit shown in Embodiment 7 which will be mentioned below can be used. In this case, target voltage values which are criteria by which the first control unit and the second control unit change the voltage Vt and the voltage Vc respectively can be stored in advance in a not-shown storage unit. By configuring an LED lighting device in accordance with any one of Embodiments 2 to 7 to carry out above-mentioned control, the LED lighting device can be constructed in such a way as to be ready for DRL.

Embodiment 2.

Figure 3:
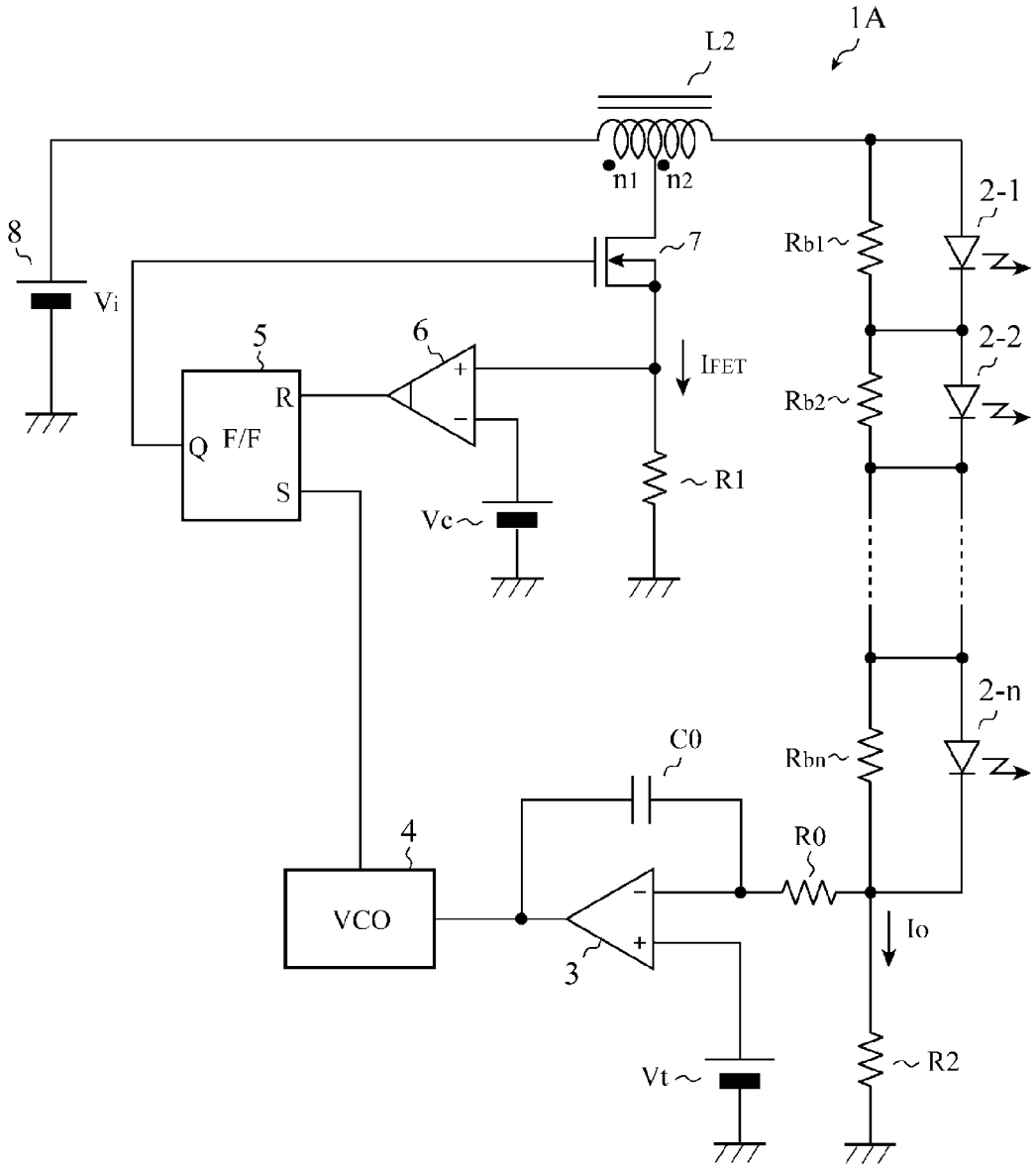
FIG. 3 is a circuit diagram showing the structure of an LED lighting device in accordance with Embodiment 2 of the present invention.

FIG. 3 is a circuit diagram showing the structure of an LED lighting device in accordance with Embodiment 2 of the present invention. As shown in FIG. 3, in the LED lighting device 1A in accordance with Embodiment 2, the choke coil L1 among the structural components shown in FIG. 1 is replaced by an auto transformer L2 (the number of turns of a primary coil is n1 and the number of turns of a secondary coil is n2). Furthermore, in the LED lighting device 1A, as elements for distributing a voltage applied to an LED circuit substantially equally among a plurality of LEDs 2-1 to 2-*n*, resistors Rb1 to Rbn are connected in parallel with the plurality of LEDs, respectively. A step-up electric power supply (a power supplying unit) is comprised of a switching transistor 7, a direct current power supply 8, and the auto transformer L2. Because the other components are the same as those shown in FIG. 1 or like components, the components are designated by the same reference numerals as those shown in the figure and the duplicate explanation will be omitted hereafter.

Next, the operation of the LED lighting device will be explained.

Figure 4:
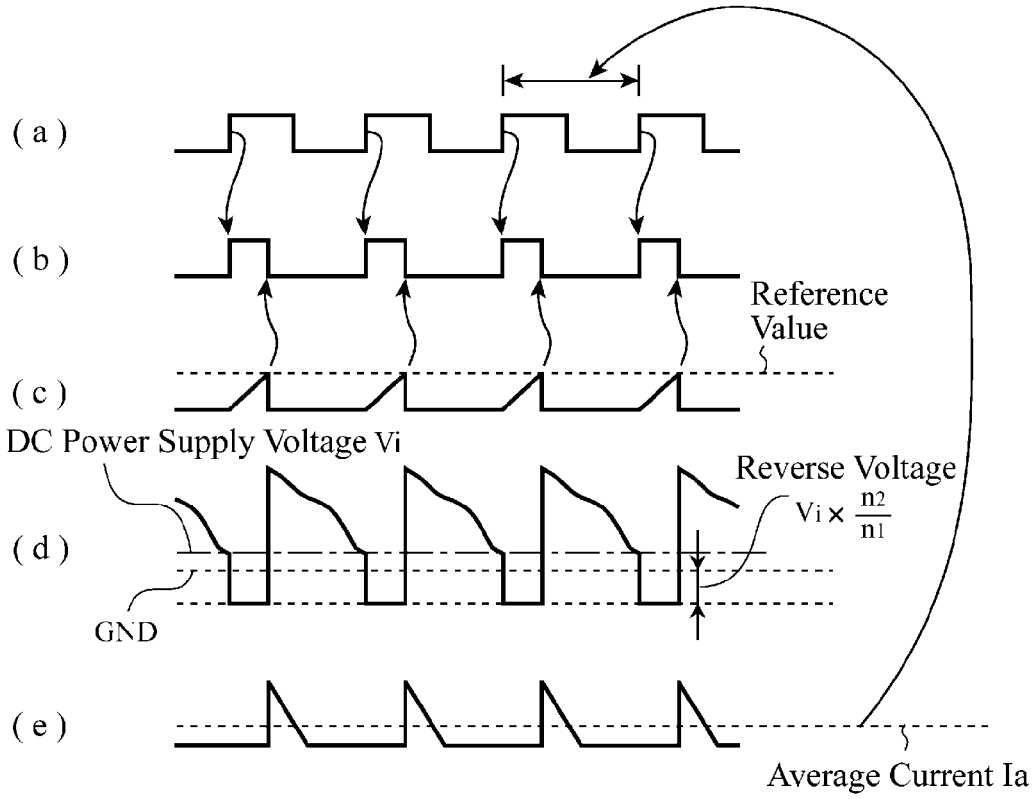
FIG. 4 is a view showing the waveform of the output of each component circuit of the LED lighting device shown in FIG. 3.

FIG. 4 is a view showing the waveform of the output of each component circuit of the LED lighting device shown in FIG. 3. FIG. 4(*a*) shows the waveform of an output voltage of an oscillator (VCO) 4, FIG. 4(*b*) shows the waveform of an output voltage of an FF 5, FIG. 4(*c*) shows the waveform of a current $I_{FET}$, and FIG. 4(*d*) shows the waveform of an output current Io. Like in the case of FIG. 2 shown in above-mentioned Embodiment 1, at the timing of the rising edge of the square wave inputted from the oscillator 4, the FF 5 outputs a driving signal which makes a transition to a high level (a high potential) via its output terminal Q (refer to FIGS. 4(*a*) and 4(*b*)).

During an on period during which the switching transistor 7 is in an on state, the pulse-shaped current $I_{FET}$ having a peak value as shown in FIG. 4(*c*) flows from the primary coil of the auto transformer L2 to between a drain terminal and a source terminal of the switching transistor. A reference value denoted by a dashed line in FIG. 4(*c*) shows the voltage of a reference power supply Vc, and a comparison between this reference value and a voltage showing the current amount of the current $I_{FET}$ occurring in a shunt resistance R1 is made by a comparator 6.

The output current Io is a pulse-shaped current which flows out of the secondary coil of the auto transformer L2 and is conducted to the LED series circuit when the switching transistor 7 is in an off state, as shown in FIG. 4(*e*). The peak current at the head of the output current Io which flows out of the secondary coil of the auto transformer L2 when the switching transistor 7 is turned off has a current value which is a multiplication of the peak current (the current $I_{FET}$) which flows from the primary coil at the end at the timing at which the switching transistor 7 is turned on by the turns ratio of the auto transformer L2 (the number of turns n1 of the primary coil/the number of turns n2 of the secondary coil).

The value of the average current Ia shown by a dashed line shown in FIG. 4(*e*) is a current value which an integrator of an error amplifier 3 acquires by averaging-processing the output current Io. A comparison between this value of the average current Ia and the target current from the reference power supply Vt is made by the error amplifier 3, and the value of the average current Ia is controlled in such a way that the value of the average current Ia is fixed to a constant, like in the case of above-mentioned Embodiment 1.

The output power during each cycle period having the above-mentioned time period can be given by (the inductance of the auto transformer L2×the square of the pulse-shaped current $I_{FET}$)/2. Therefore, because the number of cycles is proportional to the output power by fixing the pulse-shaped current $I_{FET}$ to a constant, the output power can be controlled by controlling the repetition operation in such away that the repetition operation has an arbitrary cycle period (the output square wave of the oscillator 4 shown in FIG. 4(*a*) has an arbitrary period). The LED lighting device 1A can have the same output polarity as the power supply voltage, or an output polarity which is inverse to that of the power supply voltage.

By thus fixing the value of the pulse-shaped current $I_{FET}$ to a constant, while the peak value of the output current Io is fixed to a constant, the duration of current conduction of the output current Io is shortened when the voltage applied to the LED series circuit is high, whereas the duration of current conduction of the output current Io is lengthened when the above-mentioned voltage is low. As a result, the LED lighting device in accordance with Embodiment 2 can control the output power per one pulse of the output current Io to a substantially constant without carrying out any feedback control particularly, too.

The auto transformer L2 generates a transformer forward voltage (a voltage which is reverse to a forward voltage applied to the LEDs) having a value which is a multiplication of the supply voltage V1 by (the number of turns n2 of the secondary coil/the number of turns n1 of the primary coil) at the timing which the switching transistor 7 is turned on, as shown by a dashed line shown in FIG. 4(*d*). However, even if a reverse voltage is applied to the LEDs, the LEDs are not made to light up. In FIG. 4(*d*), each portion lower than GND (a dashed line) is a forward voltage which the transformer generates, and this is a reverse voltage applied to the LEDs.

Furthermore, when a reverse voltage is applied to each LED of the LED series circuit, although some leakage current in an opposite direction occurs in each LED, the current amount differs in each LED due to individual differences in the LEDs. Therefore, in the LED series circuit, a reverse voltage concentrates on a specific LED with a fewer amount of leakage current. In this embodiment, each of the LEDs has an allowable reverse voltage of about 5V. Therefore, when a reverse voltage concentrates on a specific LED to excess, this LED may break.

To avoid this breakage, the resistors Rb1 to Rbn having the same resistance are connected in parallel to the plurality of LEDs 2-1 to 2-*n* respectively in such a way that the reverse voltage applied to the LED series circuit are distributed substantially equally among the plurality of LEDs. As a result, a reverse voltage can be prevented from concentrating on such a specific LED as mentioned above, and the reverse voltage applied to each LED can be prevented from exceeding the allowable reverse voltage.

As the elements for distributing the voltage applied to the LED series circuit substantially equally among the plurality of LEDs 2-1 to 2-*n*, instead of the resistors, capacitors or pairs of two Zener diodes whose single-sided terminals having the same polarity are connected to each other can be used.

As mentioned above, the LED lighting device 1A in accordance with this Embodiment 2 is constructed as shown in FIG. 3, and furnishes, as the output current Io, a current having a high peak value for each pulse to the LEDs 2-1 to 2-*n* at a predetermined repetition cycle period to light up the LEDs 2-1 to 2-*n*. As a result, this Embodiment 2 can provide the same advantages as those provided by above-mentioned Embodiment 1.

Furthermore, in above-mentioned Embodiment 2, because the auto transformer L2 is used instead of the choke coil L1, and the elements for distributing the voltage applied to the LED series circuit substantially equally among the plurality of LEDs 2-1 to 2-*n* are connected in parallel to the plurality of LEDs, even if a reverse voltage is generated by the auto transformer L2, the reverse voltage applied to each LED can be prevented from exceeding the allowable reverse voltage.

Embodiment 3.

Figure 5:
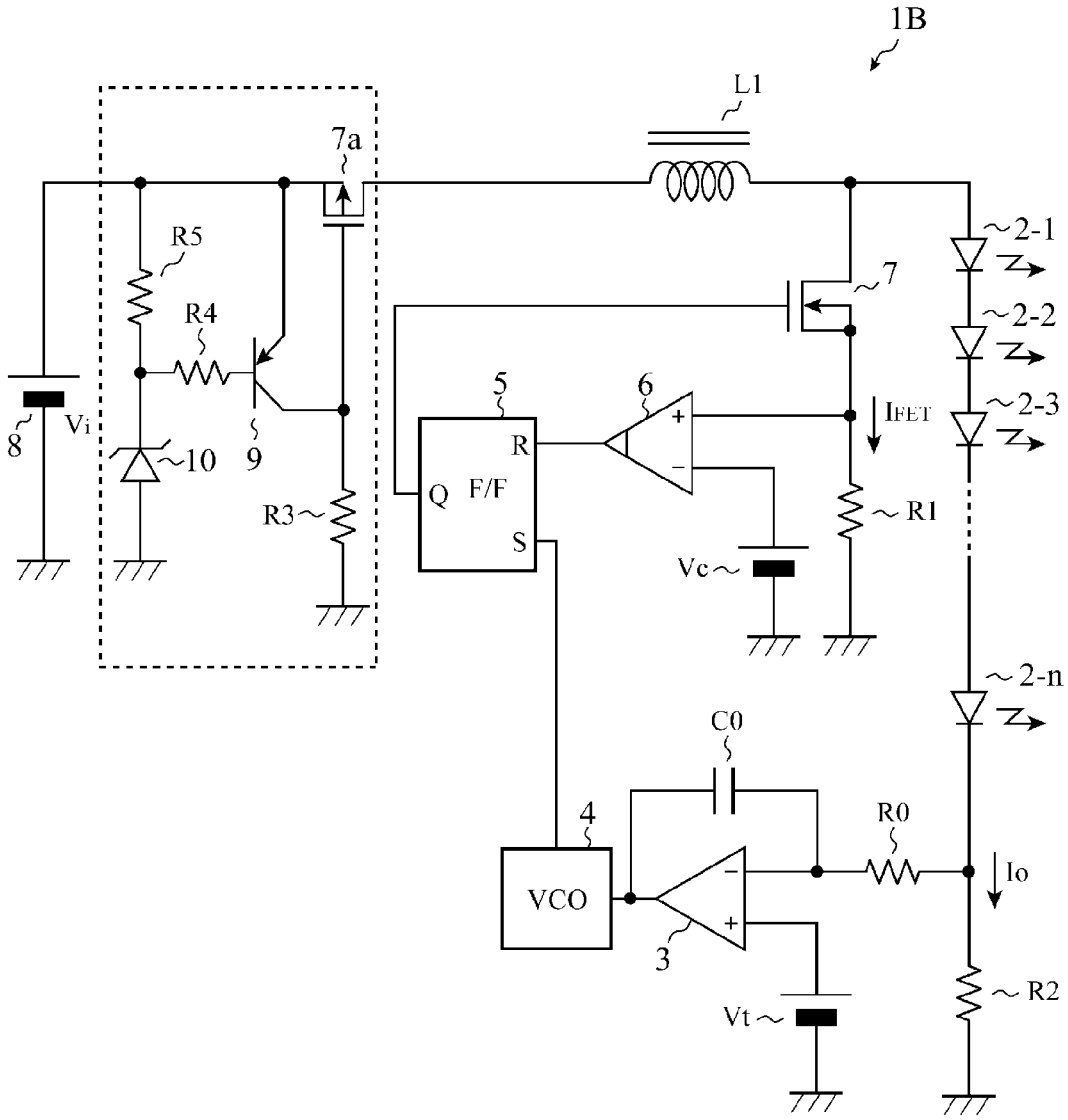
FIG. 5 is a circuit diagram showing the structure of an LED lighting device in accordance with Embodiment 3 of the present invention.

FIG. 5 is a circuit diagram showing the structure of an LED lighting device in accordance with Embodiment 3 of the present invention. As shown in FIG. 5, in the LED lighting device 1B in accordance with Embodiment 3, a circuit for blocking a power supply (a circuit enclosed by a dashed line shown in FIG. 5) (a first power supply blocking unit) is added to the structure shown in FIG. 1. For example, when each LED has a forward voltage of 3V and the number of LEDs which construct a series circuit is eight, the sum total of the forward voltages of the series circuit is 24V. However, when a direct current power supply 8 has a power supply voltage of 28V and this power supply voltage exceeds the sum total of the forward voltages of the series circuit, the current continues flowing from the direct current power supply 8 into the series circuit consisting of the plurality of LEDs while a switching transistor 7 is in an off state, and therefore an output current cannot be controlled.

To solve this problem, in accordance with Embodiment 3, the circuit for blocking the power supply when the power supply voltage of the direct current power supply 8 is high is disposed. This circuit is constructed in such a way as to have a transistor 7*a*, a transistor 9, a Zener diode 10, and resistors R3, R4, and R5, as shown in FIG. 5. The transistor 7*a* which is a field-effect transistor has a drain terminal connected to an end of a choke coil L1, a source terminal connected to an emitter terminal of the transistor 9, an end of the resistor R5, and the direct current power supply 8, and a gate terminal grounded via the resistor R3.

Furthermore, the end of the resistor R5 is connected to the direct current power supply 8, the source terminal of the transistor 7*a*, and the emitter terminal of the transistor 9, and another end of the resistor R5 is connected to a cathode of the Zener diode 10 and is grounded via the Zener diode 10. The transistor 9 consists of a bipolar transistor, and the emitter terminal of the transistor is connected to the source terminal of the transistor 7*a*, the end of the resistor R5, and the direct current power supply 8. The transistor 9 has a collector terminal connected to a junction point between the gate terminal of the transistor 7*a* and the resistor R3, and a base terminal connected, via the resistor R4, to a junction point between the resistor R5 and the Zener diode 10.

When the voltage of the direct current power supply 8 rises, and the voltage applied to the Zener diode 10 reaches the Zener voltage, a current flows from the cathode of the Zener diode 10 into the anode of the Zener diode 10 and GND via the resistor R5 and the base voltage of the transistor 9 rises via the resistor R5 and the resistor R4, and, as a result, the transistor 9 is turned on. At this time, when a current from the direct current power supply 8 flows into GND via the transistor 9 and the resistor R3, the potential difference between the source and gate of the transistor 7*a* becomes small and the transistor 7*a* enters an off state. As a result, the current from the direct current power supply 8 to the choke coil L1 is blocked.

By thus selecting the Zener diode 10 in such a way that the Zener voltage is equal to or lower than the sum total of the forward voltages of the LED series circuit, the electric power supply can be blocked in such a way that the power supply voltage does not exceed the sum total of the forward voltages of the LED series circuit. However, in actuality, the forward voltage of each LED has large variations, and it is therefore necessary to expect a design margin when calculating the sum total of the forward voltages of the series circuit. For example, it is necessary to provide a margin of about 20% for the predetermined voltage which is set for the sum total of the forward voltages of the LED series circuit to actually determine the value to be compared with the power supply voltage. For example, when eight LEDs each having a forward voltage, as mentioned above, of 3V are connected in series, it is necessary to provide a margin of about 20% for the sum total of 24V to set the value to be compared with the power supply voltage to 19V. In the above-mentioned circuit, because the LEDs go out at the time when a high power supply voltage is applied, the LED lighting device is suitable for use, as vehicle-mounted equipment, in a light source for a position lamp or the like.

As mentioned above, the LED lighting device in accordance with this Embodiment 3 can block the electric power supply in such a way that its voltage does not exceed the sum total of the forward voltages of the LED series circuit by disposing the circuit as shown in FIG. 5 in which the Zener diode 10 is selected appropriately. As a result, the LED lighting device can prevent the occurrence of abnormal operations and the breakage of the LEDs when the power supply voltage of the direct current power supply 8 is high.

In above-mentioned Embodiment 3, the case in which the above-mentioned circuit is added to the LED lighting device explained with reference to FIG. 1 in above-mentioned Embodiment 1 is shown. As an alternative, Embodiment 3 can be applied to the structure using the auto transformer L2 explained in above-mentioned Embodiment 2, and the same advantages can be provided.

Embodiment 4.

Figure 6:
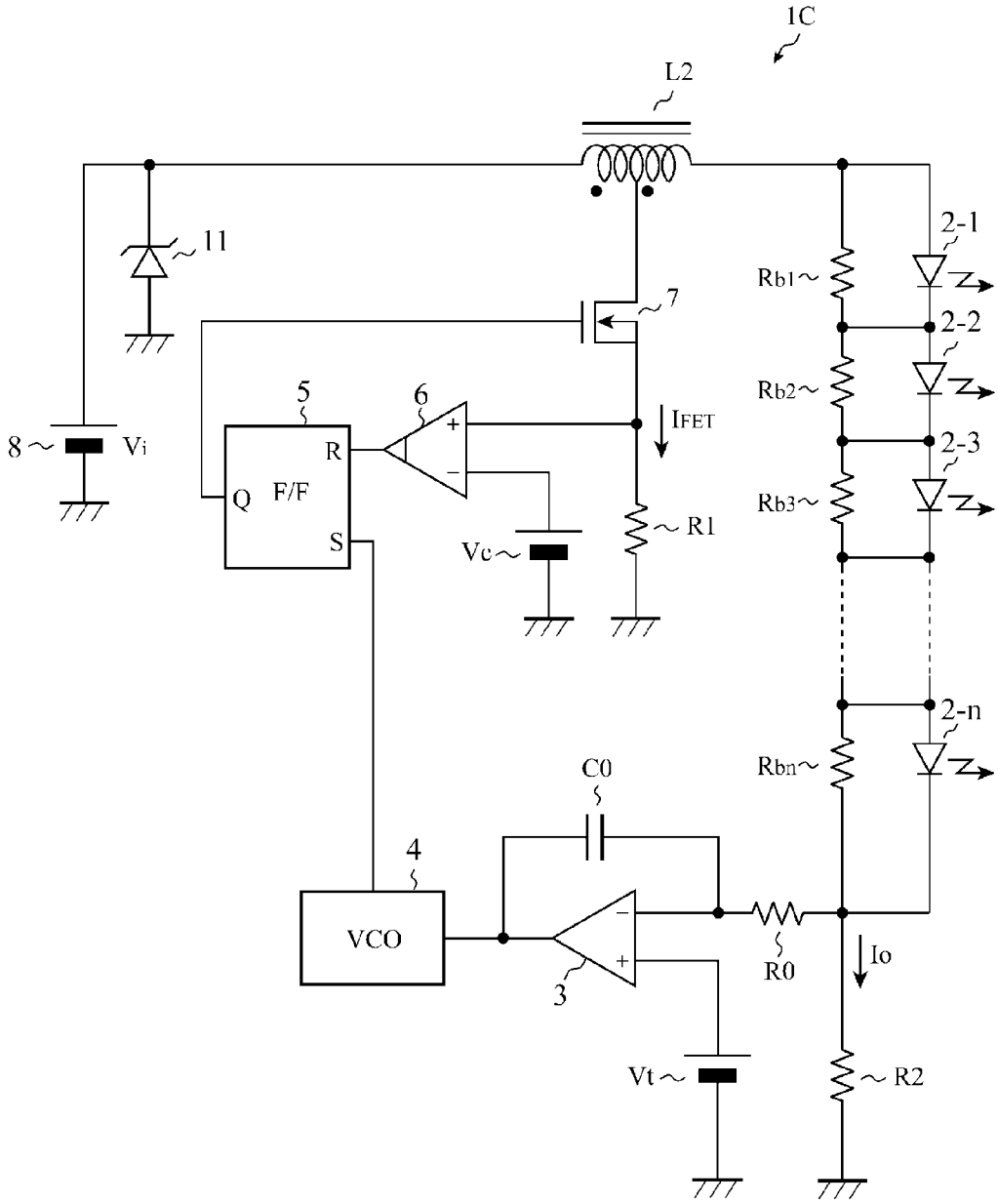
FIG. 6 is a circuit diagram showing the structure of an LED lighting device in accordance with Embodiment 4 of the present invention.

FIG. 6 is a circuit diagram showing the structure of an LED lighting device in accordance with Embodiment 4 of the present invention. In the LED lighting device 1C in accordance with Embodiment 4, a Zener diode (a first power supply limiting unit) 11 for limiting a power supply from a direct current power supply 8 is added to the structure shown in FIG. 3. As mentioned in above-mentioned Embodiment 3, even when a temporary high voltage pulse occurring when the direct current power supply 8 has a power supply voltage exceeding the sum total of the forward voltages of an LED series circuit is applied to the LED series circuit, a current continues flowing from the direct current power supply 8 into the series circuit consisting of LEDs when a switching transistor 7 is in an off state, and therefore an output current cannot be controlled.

To solve this problem, in accordance with Embodiment 4, the Zener diode 11 for limiting the power supply from the direct current power supply 8 is disposed. This Zener diode 11 consists of a power Zener diode for large electric power, for example. As shown in FIG. 6, the Zener diode has a cathode connected to the direct current power supply 8 and an end of an auto transformer L2, and an anode grounded. In this structure, even if an overvoltage exceeding a voltage which is defined in advance for the direct current power supply 8 occurs, this voltage is clipped (limited) to the Zener voltage of the Zener diode 11 and no temporary large current pulse is not conducted to the LED series circuit.

By thus selecting the Zener diode 11 appropriately, the electric power supply can be limited in such a way that the power supply voltage does not exceed the sum total of the forward voltages of the LED series circuit. In this structure, because the LEDs do not go out even when a high power source voltage is applied, the LED lighting device is suitable for use, as vehicle-mounted equipment, in a light source for a head lamp or the like.

As mentioned above, the LED lighting device in accordance with this Embodiment 4 can limit the electric power supply in such a way that the power supply voltage does not exceed the sum total of the forward voltages of the LED series circuit by disposing the Zener diode 11 for the limitation of the electric power supply. As a result, the LED lighting device can prevent the occurrence of abnormal operations and the breakage of the LEDs also when the power supply voltage of the direct current power supply 8 is high.

In above-mentioned Embodiment 4, the case in which the above-mentioned circuit is added to the LED lighting device explained with reference to FIG. 3 in above-mentioned Embodiment 2 is shown. As an alternative, Embodiment 4 can be applied to the structure of above-mentioned Embodiment 1 (the structure using the choke coil L1), and the same advantages can be provided.

Embodiment 5.

Figure 7:
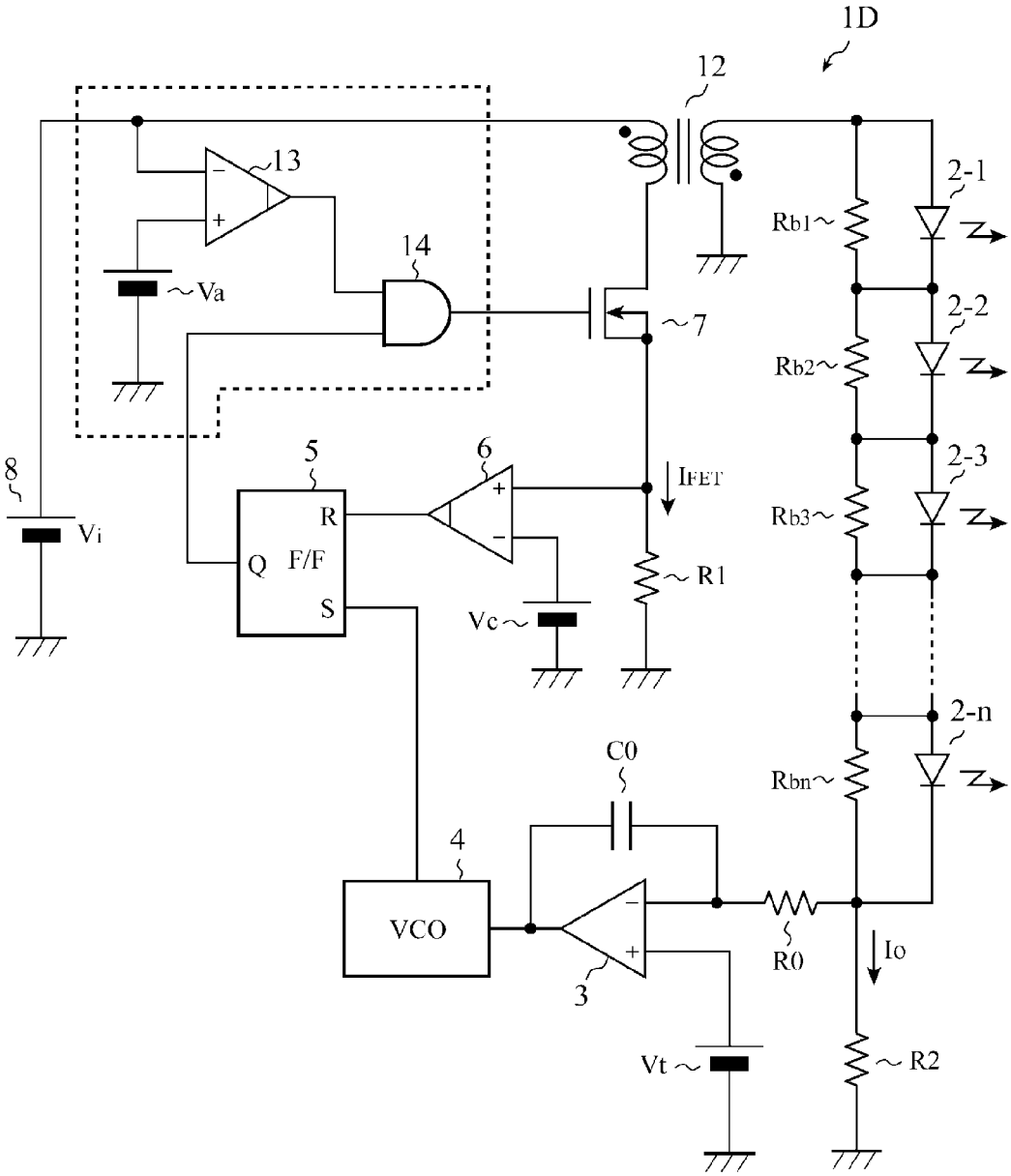
FIG. 7 is a circuit diagram showing the structure of an LED lighting device in accordance with Embodiment 5 of the present invention.

FIG. 7 is a circuit diagram showing the structure of an LED lighting device in accordance with Embodiment 5 of the present invention. As shown in FIG. 7, the LED lighting device 1D in accordance with Embodiment 5 uses an isolation transformer 12 instead of the auto transformer L2 in the structure shown in FIG. 3. When a transformer is used for a step-up electric power supply (a power supplying unit), a transformer forward voltage (a voltage which is reverse to a forward voltage applied to LEDs) occurs, as explained in above-mentioned Embodiment 2. In this case, because the allowable reverse voltage of each LED has a relatively low value (about 5V), each LED may break when the reverse voltage applied to the LED series circuit by the transformer exceeds the sum total of the allowable reverse voltage of the LED series circuit.

The LED lighting device in accordance with Embodiment 5 uses the isolation transformer 12 for which a winding on a primary side and that on a secondary side are selected in such a way that, even if a reverse voltage occurs, the reverse voltage does not exceed the sum total of the allowable reverse voltages of the LED series circuit by taking into consideration the fact that, when lighting the LED series circuit with a flyback voltage occurring in the secondary winding of the isolation transformer 12, the forward voltage occurring in the secondary winding of the isolation transformer 12 becomes a reverse voltage and is applied to the LED series circuit. This allowable reverse voltage has variations like the above-mentioned forward voltage. A setting needs to be set to a predetermined voltage for the sum total in such a way that the setting includes a design margin.

Because the LED lighting device is constructed in this way, the voltage applied to each LED does not exceed the allowable reverse voltage, and therefore each LED itself rectifies the current which is conducted to the LED series circuit into an approximately direct current. Therefore, the diodes for rectification can be omitted. Furthermore, the primary side can be separated from the secondary side in the isolation transformer 12, and breakage due to a grounding accident occurring in the output line, and so on can be easily prevented.

Furthermore, when a switching transistor 7 is turned on, a forward voltage occurs in the secondary winding of the isolation transformer 12. This forward voltage is determined by (the power supply voltage×the number of turns of the secondary coil/the number of turns of the primary coil). Therefore, when an overvoltage is furnished from a direct current power supply 8, an overvoltage in an opposite direction exceeding the sum total f the allowable reverse voltages of the LED series circuit is applied to the LED series circuit.

To solve this problem, in the LED lighting device 1D, a circuit for blocking an electric power supply when an overvoltage is furnished from the electric power supply (a circuit enclosed by a dashed line shown in FIG. 7) (a second power supply blocking unit) is disposed. The circuit is constructed in such a way as to have a comparator 13 and an AND gate 14, as shown in FIG. 7. The comparator 13 has an inverted input terminal connected to a junction point between the direct current power supply 8 and the isolation transformer 12, a non-inverted input terminal connected to a reference power supply Va, and an output terminal connected to one input terminal of the AND gate 14. The AND gate 14 has the one input terminal connected to the output terminal of the comparator 13, another input terminal connected to an output terminal Q of an FF 5, and an output terminal connected to a gate terminal of the switching transistor 7.

In the above-mentioned circuit, the comparator 13 compares the power supply voltage of the direct current power supply 8 with the predetermined voltage of the reference power supply Va (the allowable voltage which is set according to the sum total of the allowable reverse voltages of the LED series circuit). Unless the power supply voltage exceeds the predetermined voltage of the reference power supply Va, the circuit maintains the potential of the output terminal at a high level (a high potential), whereas when the power supply voltage of the direct current power supply 8 exceeds the predetermined voltage of the reference power supply Va, the circuit makes the potential of the output terminal have a low level (a low voltage).

When both the output of the FF 5 and that of the comparator 13 are at high levels, the AND gate 14 sends out a high-level output to turn on the switching transistor 7. As a result, the voltage is applied from the isolation transformer 12 to the LED series circuit. In contrast, when the direct current power supply 8 has an overvoltage and the output of the comparator 13 makes a transition to a low level, the AND gate 14 sends out a low-level output to turn off the switching transistor 7, thereby blocking the electric power supply.

Thus, when the power supply voltage which makes the forward voltage of the secondary winding of the isolation transformer 12 occurring at the time when the switching transistor 7 is turned on becomes higher than the sum total of the allowable reverse voltages of the LED series circuit is inputted, the above-mentioned circuit stops the switching operation of the switching transistor 7. Because the LEDs go out at this time, the LED lighting device 1D is suitable for use, as vehicle-mounted equipment, in a light source for a position lamp or the like.

As mentioned above, because the LED lighting device in accordance with this Embodiment 5 uses the isolation transformer 12, in which the winding of the primary side and that of the secondary side are selected in such a way that the power supply voltage does not exceed the sum total of the allowable reverse voltages of the LED series circuit, for the step-up electric power supply, a breakage due to a grounding accident of the output line, and so on can be easily avoided.

Furthermore, because the LED lighting device in accordance with Embodiment 5 is provided with the circuit for stopping the switching operation of the switching transistor 7 in such a way that the forward voltage of the secondary winding of the isolation transformer 12 does not become higher than the sum total of the allowable reverse voltages of the LED series circuit, the LED lighting device can prevent the occurrence of abnormal operations and the breakage of the LEDs resulting from the application of a reverse voltage to the LED series circuit even when the power supply voltage of the direct current power supply 8 is high.

In addition, in above-mentioned Embodiment 5, instead of the above-mentioned circuit (the circuit enclosed by a dashed line shown in FIG. 7), a Zener diode (a second power supply limiting unit) with the same connection relation as that shown in above-mentioned Embodiment 4 can be disposed. As this Zener diode, a power Zener diode for large electric power (one whose Zener voltage does not exceed the sum total of the reverse voltages of the LED series circuit) is used, for example. In the variant in which the LED lighting device is constructed in this way, because the voltage applied to the LED series circuit is clipped (limited) to the Zener voltage, the occurrence of abnormal operations and the breakage of the LEDs resulting from the application of a reverse voltage to the LED series circuit can be similarly prevented. In this variant, because the LEDs do not go out, the LED lighting device is suitable for use, as vehicle-mounted equipment, in a light source for a head lamp or the like.

Embodiment 6.

In the case in which an LED lighting device includes a single step-up electric power supply, like those in accordance with above-mentioned Embodiments 1 to 5, because a timing at which a switching transistor 7 is turned on (an output current Io is zero) exists, the rated quantity of light emission may not be acquired unless the peak current which is conducted to the LEDs is made to become larger than its rated value. For example, when the on-duty of the switching transistor 7 is 50%, the peak current must be increased to four times as large as its rated value. However, because the allowable current level of an LED having a high light emission quantity is about 2 times as large as its rated current value, it is necessary to reduce the peak current of each LED while ensuring the on-duty of the switching transistor 7.

To this end, an LED lighting device in accordance this Embodiment 6 is constructed in such a way that two step-up electric power supplies are connected in parallel, an output of an oscillator (VCO; Voltage Controlled Oscillator) 4 is shared between the two step-up electric power supplies in such a way that the operation timings of the two step-up electric power supplies occur alternately, and, while a switching transistor in one of the two step-up electric power supplies which is not outputting any current is in an on state, a switching transistor in the other step-up electric power supply is place in an off state and an output current Io is outputted to an LED series circuit, for example.

Figure 8:
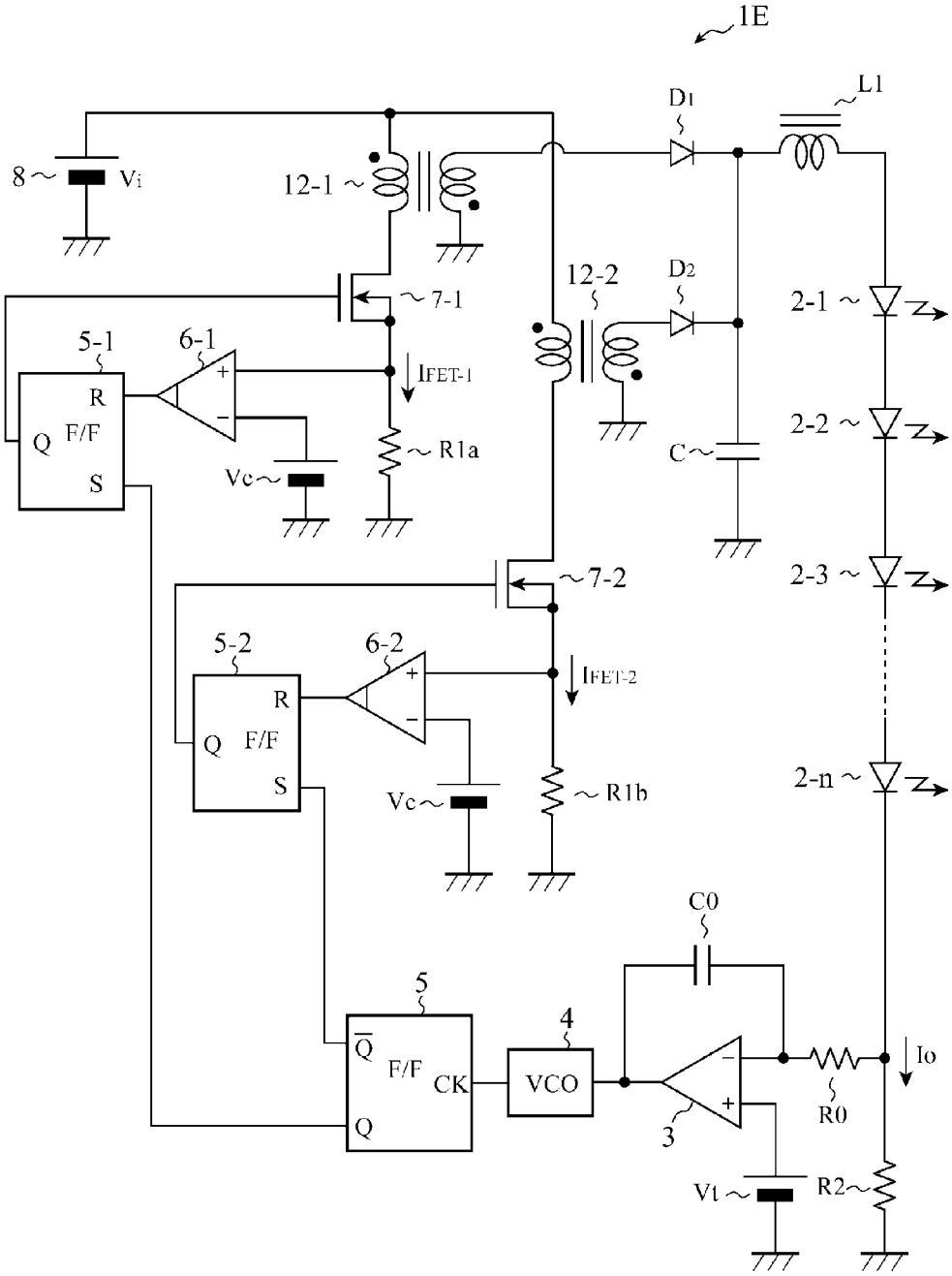
FIG. 8 is a circuit diagram showing the structure of an LED lighting device in accordance with Embodiment 6 of the present invention.

FIG. 8 is a circuit diagram showing the structure of the LED lighting device in accordance with Embodiment 6 of the present invention. As shown in FIG. 8, the LED lighting device 1E in accordance with Embodiment 6 is provided with the two step-up electric power supplies which consist of isolation transformers 12-1 and 12-2, respectively, which are connected to a direct current power supply 8. The isolation transformers 12-1 and 12-2 are connected in parallel to the direct current power supply 8 at ends of their primary windings and are also connected to drain terminals of the switching transistors 7-1 and 7-2 at other ends of their primary windings, and are further connected to anodes of diodes D1 and D2, respectively, at ends of their secondary windings Cathodes of the diodes D1 and D2 are connected to an anode of an LED 2-1 of the LED series circuit via a filter circuit which consists of a coil L1 and a capacitor C.

The switching transistors 7-1 and 7-2 have source terminals grounded via shunt resistances R1*a* and R1*b*, and gate terminals connected to output terminals Q of flip-flops 5-1 and 5-2 (abbreviated to as FFs 5-1 and 5-2 form here on), respectively. The FFs 5-1 and 5-2 have reset terminals R connected to output terminals of comparators 6-1 and 6-2, respectively, the FE 5-1 has a set terminal S connected to an output terminal Q of an FF 5, and the FF 5-2 has a set terminal S connected to an inverted output terminal Q bar of the FF 5.

The comparators 6-1 and 6-2 have inverted input terminals connected to a reference power supply Vc which provides a predetermined current value for them, and non-inverted input terminals connected to junction points between the source terminals of the switching transistors 7-1 and 7-2, and the shunt resistances R1*a* and R1*b*, respectively. Furthermore, the FF 5 has a clock terminal CK connected to the output of the oscillator 4, the output terminal Q via which the FF 5 inverts its output and outputs at every timing at which an edge of a square wave outputted from the oscillator 4 is inputted, and the inverted output terminal Q bar via which the FF 5 outputs the inversion of the output from the output terminal Q.

Next, the operation of the LED lighting device will be explained.

A pulse-shaped output current Io flowing through the LED series circuit is averaging-processed by an error amplifier 3 which serves as an integrator which employs a resistor R0 and a capacitor C0. The error amplifier 3 compares the value of the averaging-processed current Ia with a target current value from a reference power supply Vt, and applies a voltage which the error amplifier acquires by amplifying the error between them to the oscillator 4, like those in accordance with above-mentioned Embodiments 1 to 5.

The oscillator 4 outputs a square wave having an oscillating frequency according to the output voltage of the error amplifier 3 to the clock terminal CK of the FF 5 which divides the frequency of the square wave by 2. At this time, when the value of the averaged current Ia is larger than the target current value, the oscillator 4 lowers the oscillating frequency, whereas when the value of the averaged current Ia is smaller than the target current value, the oscillator 4 raises the oscillating frequency. By using the rising edge of the output terminal Q via which the FF 5 inverts its output at every timing at which the edge of the square wave inputted from the oscillator 4 is inputted thereto via the clock terminal CK, the FF 5 sets the FF 5-1, thereby turning on the switching transistor 7-1 with the output from the output terminal Q of this FF 5-1. Furthermore, by using the rising edge of the inverted output terminal Q bar via which the FF 5 outputs the inverted value, the FF 5 sets the FF 5-2, thereby turning on the switching transistor 7-2 with the output from the output terminal Q of this FF 5-2.

Furthermore, a voltage showing the current amount of a current $I_{FET\text{-}1}$ flowing from the primary coil of the isolation transformer 12-1 to between the drain and source of the switching transistor 7-1 appears across the both ends of the shunt resistance R1*a* when the switching transistor 7-1 is the on state. The comparator 6-1 compares the voltage caused by this current $I_{FET\text{-}1}$ with the predetermined voltage value of the reference power supply Vc to detect whether a voltage drop occurring in the shunt resistance R1*a* reaches the predetermined voltage value of the reference voltage Vc. Similarly, the comparator 6-2 compares a voltage caused by a current $I_{FET\text{-}2}$ with the predetermined voltage value of the reference power supply Vc to detect whether a voltage drop occurring in the shunt resistance R1*b* reaches the predetermined voltage value of the reference voltage Vc.

When each of the above-mentioned voltage drops reaches the voltage of the reference voltage Vc, the comparators 6-1 and 6-2 make the reset terminals R of the FFs 5-1 and 5-2 have a high level (a high potential), respectively. The FFs 5-1 and 5-2 make driving signals which these FFs output via their output terminals Q have a low level (a low voltage) to turn off the switching transistors 7-1 and 7-2 at the timing at which the reset terminals R are made to have a high-level potential by the comparators 6-1 and 6-2, respectively.

The output currents outputted from the two step-up electric power are added by the diodes D1 and D2, and are conducted to the LED series circuit. At this time, a steep current change in the output current Io is suppressed by the filter circuit which consists of the coil L1 and the capacitor C, and noise is removed from the output current.

Figure 9:
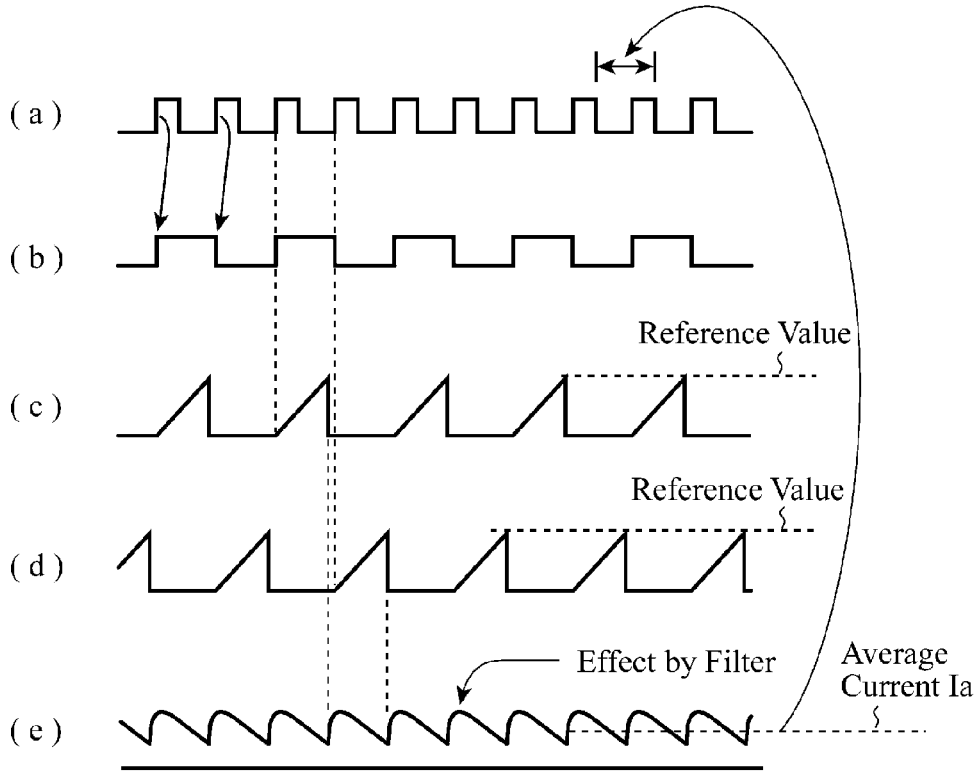
FIG. 9 is a view showing the waveform of the output of each component circuit of the LED lighting device shown in FIG. 8.

FIG. 9 is a view showing the waveform of the output of each component circuit of the LED lighting device shown in FIG. 8, FIG. 9(*a*) shows the waveform of the output voltage of the oscillator (VCO) 4, FIG. 9(*b*) shows the waveform of the output voltage from the output terminal Q of the FF 5, FIG. 9(*c*) shows the waveform of the current $I_{FET\text{-}1}$ flowing through the isolation transformer 12-1 and the switching transistor 7-1, FIG. 9(*d*) shows the waveform of the current $I_{FET\text{-}2}$ flowing through the isolation transformer 12-2 and the switching transistor 7-2, and FIG. 9(*e*) shows the waveform of the output current Io. FIGS. 9(*a*) and 9(*b*) show a state in which the FF 5 inverts the output appearing at the output terminal Q thereof at the timing of the rising edge of the square wave inputted from the oscillator 4 and a state in which the FF 5 inverts the output appearing at the inverted output terminal Q bar thereof at the timing of the rising edge of the square wave, respectively.

The switching transistors 7-1 and 7-2 enter the on state while the driving signals from the FFs 5-1 and 5-2 are at a high level, and enter the off state when the driving signals make a transition to a low level (a low voltage), respectively. The switching transistors 7-1 and 7-2 also operate alternately according to the square waves which are outputted from the FF 5 and which are inverse of each other. As a result, as shown in FIGS. 9(*c*) and 9(*d*), the currents $I_{FET\text{-}1}$ and $I_{FET\text{-}2}$ flow from the isolation transformers 12-1 and 12-2 to between the drains and sources of the switching transistors 7-1 and 7-2 respectively in such a way that the off time periods of the switching transistors 7-1 and 7-2 are complementary to each other.

Each of reference values denoted by dashed lines in FIGS. 9(*c*) and 9(*d*) shows the voltage of the reference power supply Vc, and comparisons between this reference value and the voltages showing the current amounts of the currents $I_{FET\text{-}1}$ and $I_{FET\text{-}2}$ occurring in the shunt resistances R1*a* and R1*b* are made by the comparators 6-1 and 6-2, respectively. Furthermore, as shown by dashed lines drawn to extend from FIG. 9(*a*) to FIGS. 9(*c*) and 9(*d*), the rising edge of the output square wave of the oscillator 4 shown in FIG. 9(*a*) is alternately delivered to the switching transistors 7-1 and 7-2 in such a way that the switching transistors operate alternately and a conduction current flows through the switching transistors alternately.

The output current Io is added by the diodes D1 and D2, and is the sum total of the pulse-shaped current which flows from the isolation transformer 12-1 into the LED series circuit when the switching transistor 7-1 is in the off state, and the pulse-shaped current which flows from the isolation transformer 12-2 into the LED series circuit when the switching transistor 7-2 is in the off state, as shown in FIG. 9(*e*).

These output currents from both the step-up electric power supplies have steeple portions which are suppressed smoothly by the filter circuit which consists of the coil L and the capacitor C, as shown in FIG. 9(*e*), and have a waveform similar to that of a sign wave. Because the filter circuit which consists of the coil L1 and the capacitor C is thus disposed in the route via which the output current from each step-up electric power supply is conducted to the LED series circuit, the occurrence of a steep current can be suppressed and the occurrence of noise can be reduced. This filter circuit can be disposed in the structure in accordance with any one of above-mentioned Embodiments 1 to 5.

The value of the average current Ia shown by a dashed line shown in FIG. 9(*e*) is the current value which an integrator of the error amplifier 3 acquires by averaging-processing the output current Io. A comparison between this value of the average current Ia and the target current from the reference power supply Vt is made by the error amplifier 3, and the value of the average current Ia is controlled in such a way that the value of the average current Ia is fixed to a constant.

As mentioned above, the LED lighting device 1E in accordance with this Embodiment 6 is constructed as shown in FIG. 8, shares and uses the output of the oscillator 4 between the operation timings of the two step-up electric power supplies, and, while the switching transistor in one of the two step-up electric power supplies which is not outputting any current, turns off the switching transistor in the other step-up electric power supply to sum their output currents by using the diodes D1 and D2 and conduct the sum of the output currents to the LED series circuit. Because the LED lighting device is constructed in this way, the LED lighting device can conduct a current close to a rated current (a direct current) to the LEDs to make the LEDs light up without conducting an excessive peak current to the LEDs.

In above-mentioned Embodiment 6, the structure in which the two step-up electric power supplies are connected in parallel is shown. As an alternative, the LED lighting device can be constructed in such a way that three or more step-up electric power supplies are connected in parallel, and the periods of time during which the three or more step-up electric power supplies generate their respective output currents are complementary to one another.

Furthermore, in above-mentioned Embodiment 6, the structure in which the isolation transformers 12-1 and 12-2 are used as the step-up electric power supplies is mentioned as an example. As an alternative, a plurality of electric power supplies each using a choke coil L1 as shown in above-mentioned Embodiment 1 or an auto transformer L2 as shown in above-mentioned Embodiment 2 can be connected in parallel and can be controlled in such a way that the periods of time during which currents to be outputted to the LED series circuit are conducted to the LED series circuit are complementary to one another. This variant can provide the same advantages as those provided by above-mentioned Embodiment 6.

Embodiment 7.

An LED lighting device in accordance with this Embodiment 7 is provided with at least one of a first control unit for arbitrarily adjusting a pulsed current value which is conducted to an LED series circuit (the value of an output current Io), and a second control unit for arbitrarily adjusting the value of an average current Ia which is conducted to the LED series circuit. As each of the first and second control units, either a unit that uses a variable resistance to adjust a reference value (Vc) which is compared with a current IFET flowing through a coil L1 and a switching transistor 7, and a value (Vt) corresponding to a current which is a target when amplifying an error between the value of the output current Io and the target current to arbitrary voltages in a structure shown in, for example, FIG. 1 explained in above-mentioned Embodiment 1 or a unit that adjusts the reference value (Vc) and the value (Vt) to analog voltage values into which the unit converts an output of a not-shown microcomputer (a CPU) which carries out light control of the LED lighting device by using a D/A converter can be used.

As an example of the timing at which the above-mentioned variable resistance is set to a certain value or appropriate information is set to the CPU, a time within a process during which the product (the LED lighting device) is assembled before it is shipped can be taken. At this timing, the variable resistance is manipulated or certain data is stored in the CPU in such a way that a predetermined light color or a predetermined light emission quantity is provided. The data which the CPU uses can be alternatively stored in an EEPROM (Electronically Erasable and Programmable Read Only Memory) as a storage medium.

Thus, a certain value (a comparison reference value) for the reference value (Vc) which makes the LEDs provide the predetermined light color, and a certain value (a comparison reference value) for the target value (Vt) which makes the LEDs light up with the predetermined light emission quantity are predetermined, and the adjustment of the value of the above-mentioned variable resistance or the LED light control by the above-mentioned CPU is carried out on the basis of the certain values.

As another example of the above-mentioned timing, a time at which an age deterioration occurs after the LEDs have been used for a long time can be taken. At this time, the above-mentioned CPU can correct the reference value Vc or the target value Vt on the basis of characteristic change data which are prepared in advance. For example, the CPU monitors a change in the light emission quantity of the LEDs from the output voltage value, the current value or the like, and, when the LEDs become dark (a change occurs) due to an age deterioration, the CPU adjusts the brightness by adjusting the target value Vt and then increasing the output current value (by increasing the value of the average current Ia).

As a further example of the timing, a time at which the accumulated lighting time of the LEDs reaches a predetermined lighting time can be taken. At this time, the value of the average current Ia can be adjusted again. For example, when the accumulated lighting time reaches the predetermined time, the LED lighting device determines that the LEDs become dark due to an age deterioration, and adjusts the target value Vt to a predetermined value and increases the value of the average current Ia to correct the LEDs to predetermined brightness.

As mentioned above, because the LED lighting device in accordance with this Embodiment 7 is provided with at least one of the first control unit for arbitrarily adjusting the pulsed current value which is conducted to the LED series circuit (the value of the output current Io), and the second control unit for arbitrarily adjusting the value of the average current Ia which is conducted to the LED series circuit, the LED lighting device can adjust or correct the light emission quantity and the light color of the LEDs to an arbitrary value and an arbitrary color independently, respectively.

In above-mentioned Embodiment 7, although the case in which it is applied to the structure in accordance with above-mentioned Embodiment 1 is shown, the unit for arbitrarily adjusting at least one of the value of the pulsed current which is conducted to the LED series circuit (the value of the output current Io), and the value of the average current Ia which is conducted to the LED series circuit can be disposed in the structure in accordance with any one of above-mentioned Embodiments 2 to 6. In this variant, the same advantages as those provided by above-mentioned Embodiment 7 are provided.

Industrial Applicability

In the LED lighting device and the LED head lamp in accordance with the present invention, the LED lighting device can be implemented via a simple circuit which carries out on and off control of a switching element at a predetermined cycle period and can reduce the component count, for example. Therefore, each of the LED lighting device and the LED head lamp in accordance with the present invention is suitable for use as an LED lighting device that makes LEDs, which are used as a light source for a vehicle-mounted head lamp, a tail lamp or the like, light up.

The invention claimed is:

1. An LED lighting device including an LED circuit in which a plurality of LEDs connected to a direct current power supply via an inductor are connected in series, and a switching element for feeding a current to said inductor, said LED lighting device turning on said switching element to conduct the current from said direct current power supply to said inductor, and, after that, outputting a pulse-shaped current which is generated by turning off said switching element from said inductor to said LED circuit to light up said LED circuit, said LED lighting device comprising:

a unit for controlling a peak value of said pulse-shaped current outputted to said LED circuit to a predetermined value by adjusting a current conducted to said switching element when turning off said switching element to a predetermined value; and a cycle determining unit for controlling an average of said pulse-shaped current outputted from said inductor to said LED circuit in such a way that the average is maintained at a predetermined value by adjusting a duty cycle of said switching element which operates at a nearly-fixed cycle period, wherein said inductor is a choke coil or an auto transformer, and said LED lighting device includes a first power supply blocking unit disposed on a route between said direct current power supply and said choke coil or said auto transformer, for blocking a supply of electric power to said inductor when said direct current power supply has a voltage higher than a predetermined voltage set up for a sum total of forward voltages of said plurality of LEDs of said LED circuit.

2. An LED lighting device including an LED circuit in which a plurality of LEDs connected to a direct current power supply via an inductor are connected in series, and a switching element for feeding a current to said inductor, said LED lighting device turning on said switching element to conduct the current from said direct current power supply to said inductor, and, after that, outputting a pulse-shaped current which is generated by turning off said switching element from said inductor to said LED circuit to light up said LED circuit, said LED lighting device comprising:

a unit for controlling a peak value of said pulse-shaped current outputted to said LED circuit to a predetermined value by adjusting a current conducted to said switching element when turning off said switching element to a predetermined value; and a cycle determining unit for controlling an average of said pulse-shaped current outputted from said inductor to said LED circuit in such a way that the average is maintained at a predetermined value by adjusting a duty cycle of said switching element which operates at a nearly-fixed cycle period, wherein said inductor is a choke coil or an auto transformer, and said LED lighting device includes a first power supply limiting unit disposed on a route between said direct current power supply and said choke coil or said auto transformer, for limiting an amount of supply of electric power supplied to said inductor when said direct current power supply has a voltage higher than a predetermined voltage set up for a sum total of forward voltages of said plurality of LEDs of said LED circuit.

3. An LED lighting device including an LED circuit in which a plurality of LEDs connected to a direct current power supply via an inductor are connected in series, and a switching element for feeding a current to said inductor, said LED lighting device turning on said switching element to conduct the current from said direct current power supply to said inductor, and, after that, outputting a pulse-shaped current which is generated by turning off said switching element from said inductor to said LED circuit to light up said LED circuit, said LED lighting device comprising:

a unit for controlling a peak value of said pulse-shaped current outputted to said LED circuit to a predetermined value by adjusting a current conducted to said switching element when turning off said switching element to a predetermined value; and a cycle determining unit for controlling an average of said pulse-shaped current outputted from said inductor to said LED circuit in such a way that the average is maintained at a predetermined value by adjusting a duty cycle of said switching element which operates at a nearly-fixed cycle period, wherein said inductor is an isolation transformer, and said LED lighting device includes a second power supply blocking unit for stopping said switching element's operation of conducting the current to said isolation transformer when said direct current power supply has a high voltage, and a forward voltage occurring in a secondary winding of said isolation transformer is higher than a predetermined voltage set up for a sum total of allowable reverse voltages of said plurality of LEDs of said LED circuit.

4. An LED lighting device including an LED circuit in which a plurality of LEDs connected to a direct current power supply via an inductor are connected in series, and a switching element for feeding a current to said inductor, said LED lighting device turning on said switching element to conduct the current from said direct current power supply to said inductor, and, after that, outputting a pulse-shaped current which is generated by turning off said switching element from said inductor to said LED circuit to light up said LED circuit, said LED lighting device comprising:

a unit for controlling a peak value of said pulse-shaped current outputted to said LED circuit to a predetermined value by adjusting a current conducted to said switching element when turning off said switching element to a predetermined value; and a cycle determining unit for controlling an average of said pulse-shaped current outputted from said inductor to said LED circuit in such a way that the average is maintained at a predetermined value by adjusting a duty cycle of said switching element which operates at a nearly-fixed cycle period, wherein said inductor is an isolation transformer, and said LED lighting device includes a second power supply limiting unit disposed on a route between said direct current power supply and said isolation transformer, for limiting an amount of supply of electric power furnished to said isolation transformer when said direct current power supply has a high voltage, and a forward voltage occurring in a secondary winding of said isolation transformer is higher than a predetermined voltage set up for a sum total of allowable reverse voltages of said plurality of LEDs of said LED circuit.

5. The LED lighting device according to claim 1, wherein said LED lighting device includes elements connected in parallel to the plurality of LEDs of said LED circuit respectively, for distributing a reverse voltage applied to said LED circuit substantially equally among said plurality of LEDs.

6. The LED lighting device according to claim 1, wherein said LED lighting device includes a plurality of circuits connected in parallel to one another, each including said inductor and said switching element, and said cycle determining unit determines the duty cycle of each of said plurality of switching elements to make said plurality of switching elements operate in such a way that said plurality of switching elements have operation timings which are complementary to one another.

7. The LED lighting device according to claim 1, wherein said LED lighting device includes a filter circuit for reducing a steep change in the output current outputted to said LED circuit.

8. The LED lighting device according to claim 1, wherein said LED lighting device adjusts a peak value of the pulse-shaped current which is conducted to said LED circuit to adjust a light color of said LED circuit by adjusting a setting of said unit.

9. The LED lighting device according to claim 8, wherein the adjustment of said unit is carried out during a process performed before said LED lighting device is shipped and after said LED lighting device has been assembled.

10. The LED lighting device according to claim 8, wherein said LED lighting device adjusts a setting of said unit in order to change the peak value of the pulse-shaped current which is conducted to said LED circuit according to lighting times of the LEDs.

11. The LED lighting device according to claim 1, wherein said LED lighting device adjusts the average of the current which is conducted to said LED circuit to adjust a light emission quantity of said LED circuit by adjusting a setting of said cycle determining unit.

12. The LED lighting device according to claim 11, wherein the adjustment of said cycle determining unit is carried out during a process performed before said LED lighting device is shipped and after said LED lighting device has been assembled.

13. The LED lighting device according to claim 11, wherein said LED lighting device adjusts a setting of said cycle determining unit in order to change the average of the current which is conducted to said LED circuit according to lighting times of the LEDs.

14. The LED lighting device according to claim 1, wherein said unit and/or said cycle determining unit includes a storage unit for storing data corresponding to the peak value of said pulse-shaped current and/or a setting showing the average of said pulse-shaped current, said first control unit and/or said cycle determining unit referring to said data when carrying out said control.

15. The LED lighting device according to claim 1, wherein said pulse-shaped current has a period corresponding a frequency which is equal to or higher than 20kHz and is equal to or lower than 1MHz, and a non-rectangle waveform.

16. A head lamp LED lighting device comprising:

a head lamp having, as a light source, an LED circuit connected to a direct current power supply via an inductor;

a switching element;

a unit for turning on said switching element to conduct a current from said direct current power supply to said inductor, and, when the current conducted to said inductor reaches a predetermined value, turning off said switching element and outputting a pulse-shaped current which is generated through turning off said switching element from said inductor to said LED circuit to conduct the pulse-shaped current generated by said inductor to said LED circuit, thereby lighting up said LED circuit, and a cycle determining unit for determining a cycle period at which said switching element operates according to an average of the current conducted to said LED circuit, where said inductor is a choke coil or an auto transformer, and said LED lighting device includes a first power supply blocking unit disposed on a rout between said direct current power supply and said choke coil or said auto transformer, for blocking a supply of electric power to said inductor when said direct current power supply has a voltage higher than a predetermined voltage set up for a sum total of forward voltages of a plurality of LEDs of said LED current.

17. The head lamp LED lighting device according to claim 16, wherein a change of a setting of said unit for changing the peak value of said pulse-shaped current and/or a change of a setting of said cycle determining unit for changing said average current value of said pulse-shaped current is carried out according to a switch operation performed by a driver operating a vehicle or a result of a detection made by an illumination detecting unit for detecting peripheral illumination of the vehicle.

18. The head lamp LED lighting device according to claim 16, wherein a setting of said unit for changing the peak value of said pulse-shaped current and/or a setting of said cycle determining unit for changing said average current value of said pulse-shaped current are set up in such a way that a light color and a light emission quantity of said LED circuit get close to specified values of a head lamp.

* * * * *